US009227192B2

(12) United States Patent
Roy et al.

(10) Patent No.: US 9,227,192 B2
(45) **Date of Patent: *Jan. 5, 2016**

(54) CHIPPER STRIKER ASSEMBLY

(76) Inventors: David Roy, Derry, NH (US); Daniel Roy, Derry, NH (US); Norm Roy, Derry, NH (US)

( * ) Notice: Subject to any disclaimer, the term of this patent is extended or adjusted under 35 U.S.C. 154(b) by 351 days.

This patent is subject to a terminal disclaimer.

(21) Appl. No.: 13/153,744

(22) Filed: Jun. 6, 2011

(65) Prior Publication Data

US 2012/0305691 A1 Dec. 6, 2012

(51) Int. Cl.
*B02C 18/14* (2006.01)
*B02C 13/28* (2006.01)
*B02C 18/18* (2006.01)

(52) U.S. Cl.
CPC ..... *B02C 13/2804* (2013.01); *B02C 18/145* (2013.01); *B02C 18/184* (2013.01); *Y10T 29/49826* (2015.01)

(58) Field of Classification Search
CPC ..... B02C 1/00; B02C 13/00; B02C 13/06; B02C 13/09; B02C 13/26; B02C 13/28; B02C 18/14
USPC ..... 241/293, 294, 88.1, 93, 280, 282.2, 241/298, 297, 291; 144/21, 23, 24, 226, 144/227, 228, 231, 234, 241, 334, 337; 407/42, 46
See application file for complete search history.

(56) References Cited

U.S. PATENT DOCUMENTS

| | | | | | |
|---|---|---|---|---|---|
| 3,614,214 | A | * | 10/1971 | Cornsweet et al. | 351/206 |
| 3,642,214 | A | * | 2/1972 | Blackwell, Jr. | 241/191 |
| 4,043,012 | A | * | 8/1977 | Rowlson et al. | 407/45 |
| 5,176,191 | A | * | 1/1993 | Owens | 144/230 |
| 5,209,278 | A | * | 5/1993 | Carpenter et al. | 144/230 |
| 5,271,440 | A | * | 12/1993 | Bradstreet et al. | 144/176 |
| 5,873,534 | A | | 2/1999 | Shinn | |
| 5,988,544 | A | * | 11/1999 | Williams, Jr. | 241/294 |
| 6,079,649 | A | * | 6/2000 | Balvanz et al. | 241/189.1 |
| 6,322,012 | B1 | * | 11/2001 | Paper | 241/243 |
| 6,517,020 | B1 | | 2/2003 | Smith | |
| 6,520,440 | B2 | | 2/2003 | Ragnarsson | |
| 7,004,413 | B2 | | 2/2006 | Langlois | |
| D525,635 | S | | 7/2006 | East | |
| 7,118,311 | B2 | * | 10/2006 | Astrom | 407/46 |
| 7,290,726 | B2 | | 11/2007 | Latham | |
| D567,832 | S | | 4/2008 | Edwards | |
| 7,726,594 | B2 | | 6/2010 | Smith | |
| 7,891,388 | B2 | * | 2/2011 | Hinchliff | 144/230 |
| 2009/0057453 | A1 | | 3/2009 | Ellison | |

* cited by examiner

*Primary Examiner* — Mark Rosenbaum
(74) *Attorney, Agent, or Firm* — Lambert & Associates; Gary E. Lambert; David J. Connaughton, Jr.

(57) ABSTRACT

A chipper striker assembly allowing for the adjustment of the striker blade. The chipper striker assembly having a base capable of attachment to a rotor, an adjustment portion connected to the base, and a striker blade, wherein the adjustment portion is capable of connection to the base in a plurality of adjustment positions.

10 Claims, 5 Drawing Sheets

CHIPPER STRIKER ASSEMBLY

FIELD OF THE INVENTION

The present disclosure relates generally to chippers, grinders, and comminuting devices and in particular relates to a striker blade for chippers, grinders and comminuting devices.

DESCRIPTION OF RELATED ART

Industrial wood chippers and shredders have become essential equipments in many processing and manufacturing facilities. These equipments are also commonly referred to as hammer mills, pulverizer or hogs. Initially used mostly to grind bark removed from raw logs in sawmills and pulp mills, they are now widely used for the size reduction of a variety of materials including dry solids.

Conventional chippers are frequently used for grinding raw logs which can then be burned as fuel or sold as horticultural mulch. The chippers are also typically used for grinding a wide range of other materials including tree stumps, slash from logging operations, land fill trash, soft metals such as aluminum and copper scraps, used automobile and light truck tires, construction dunnage and even some food products such as grinding applies into mash in preparation for making apple cider.

Whatever the use, the chippers conventionally employ a plurality of strikers mounted on a surface of a motor driven rotor. The strikers are adapted to shred or crush materials which are fed through the chippers by forcing materials against a grate, breaking them down by the shredding forces between the grate and the striker. Typically, conventional chippers use strikers that are formed as one piece from a homogeneous material typically through a casting and/or machining manufacturing process.

Although chippers have been in common use for an extended period of time, they nevertheless suffer from at least one main drawback. Indeed, the strikers, striker blades and/or teeth of the rotor are arranged with respect to the rotor so that they encounter virtually all of the compressive and impact forces. Accordingly, they are subject to rapid wear and deterioration. The deterioration of the strikers, in turn, leads to gradual loss of efficiency and may even potentially lead to break down of the chipper. In particular, as the strikers wear, the operating distance between the striker and the grate increases. As this increase exceeds specified tolerances, the effectiveness of the shredder decreases exponentially.

While the wear points of the strikers are substantially at the outer portion, industry practice is for entire strikers to be replaced periodically. This, in turn, leads to relatively large operational costs. Not only must the chipper be halted during replacement procedures but the striker blades which are made out of a relatively strong material are quite expensive. Because of the relatively high costs, in practice, the striker blades are seldom replaced with the required frequency to maintain good cutting characteristics.

In order to reduce the costs associated with maintenance of the strikers, some users have resorted to resurfacing the cutting edges of the strikers by hard face welding metal to the cutting edges or sharpening them. Typically, the resurfacing operation necessitates that the striker blade be removed from the rotor, transported to a resurfacing device and transported back to the grinding machine where they are reconnected to the rotor.

The extensive time delays encountered in the resurfacing process are problematic and onerous. It is thus often necessary to maintain a complete set of spare sharpened striker blades at the grinding site to minimize the downtime of the chipper. In some instances, this may prove to be difficult. For example, in situations wherein the chippers are portable and transported to various locations, maintaining a supply of extra striker blades may even prove to be impossible.

Further in the event that a large, hard object, such as a stone or piece of metal is jammed in the chipper, a striker may be entirely destroyed, even though only a portion of it is jammed against the large hard object.

Therefore, what is needed is a striker assembly that decreases the cost of replacing the worn striker cutting edges and that does not need to be entirely replaced.

SUMMARY OF THE INVENTION

The subject matter of this application may involve, in some cases, interrelated products, alternative solutions to a particular problem, and/or a plurality of different uses of a single system or article.

In one aspect, a chipper striker assembly is provided comprising a base, capable of attachment to a rotor, an adjustment portion connected to the base, and a striker blade, connected to the adjustment portion, and wherein the adjustment portion is capable of connection to the base in a plurality of adjustment positions.

In another aspect, a chipper striker assembly is provided comprising a base, capable of attachment to a rotor, and having a plurality of grooves indented into a face, an adjustment portion connected to the base, mating with the plurality of grooves of the base, a striker blade, connected to the adjustment portion, wherein the adjustment portion is capable of connection to the base in a plurality of adjustment positions, wherein the adjustment portion has a rear face having a plurality of protruding grooves, and a front face having a raised section, and wherein the plurality of indented grooves of the base and the plurality of protruding grooves of the adjustment portion are mated together.

In yet another aspect, a method of adjusting a chipper striker blade is provided comprising the steps of evaluating an amount of wear on a striker blade, detaching a striker blade from an adjustment portion of a striker assembly and positioning the striker blade such that a distance between the striker blade and a grate are within a specific tolerance.

DETAILED DESCRIPTION

Figure 1:
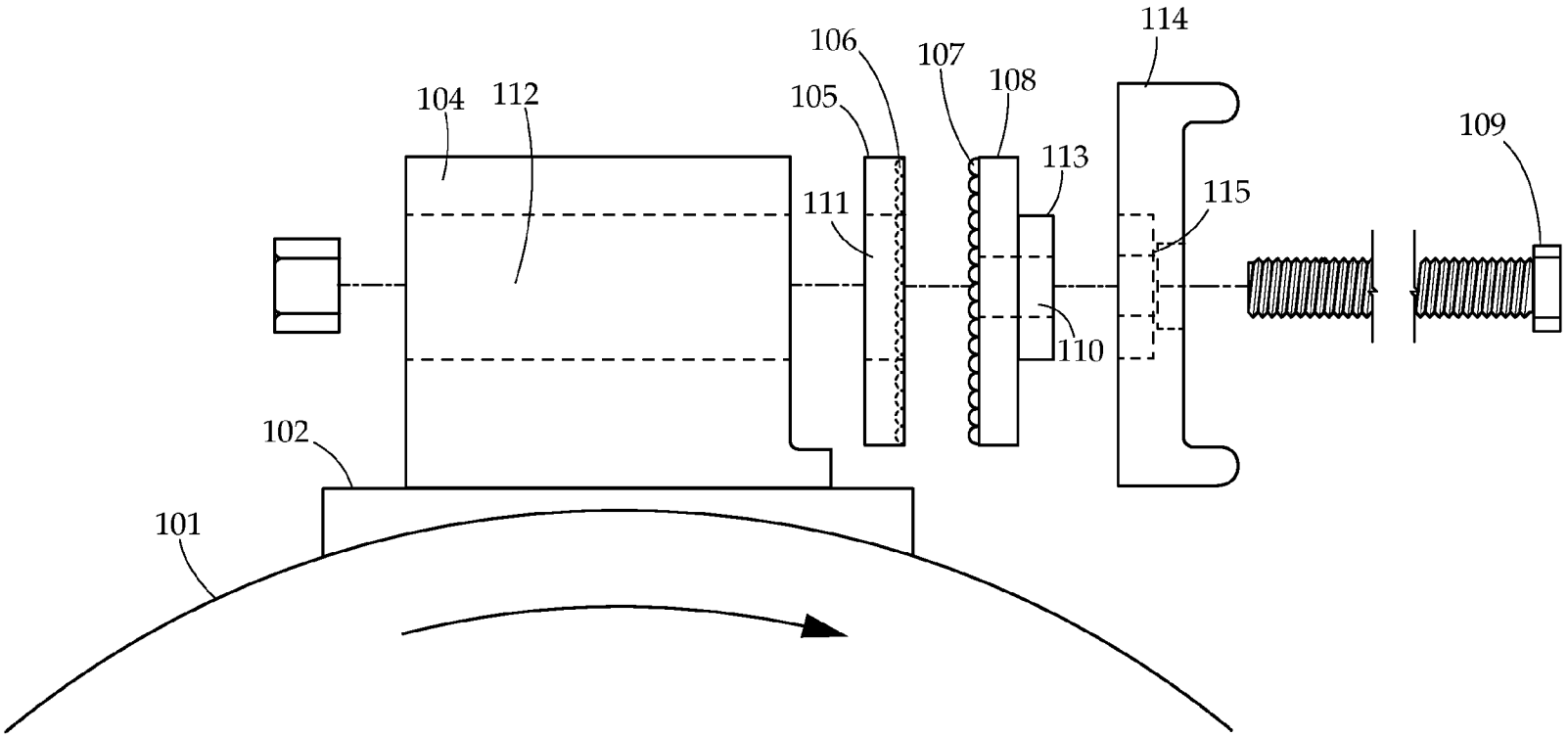
FIG. 1 provides an illustration of an exploded view of an embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention provides a striker assembly used in chippers. The striker assembly described herein can be easily mounted to a rotor of a variety of different chipper arrangements. The striker assembly may have a base, that attaches to the rotor and provides structure for the assembly. The base may comprise an adjustment portion, such that as a portion of a cutting blade is worn down through use, a blade position may be easily adjusted to accommodate for the wear, instead of replacing the entire cutting blade. The striker assembly described herein may secure almost any industry-standard striker blades that are known in the art, thereby greatly increasing the flexibility of the invention. Therefore, the striker assembly provides substantial value in terms of savings on replacement costs and downtime costs.

The terms "wood chipper" and "chipper" are defined herein to refer not only to devices capable of chipping, grinding and/or shredding wood, but also refer to grinders that are now widely used for the size reduction of a variety of materials including dry solids. These grinders may be used to reduce the size of wood and wood based material, but also slash from logging operations, land fill trash, soft metals such as aluminum and copper scraps, used automobile and light truck tires, construction dunnage and even some food products such as grinding applies into mash in preparation for making apple cider.

In one aspect, the present invention provides a striker assembly used in chippers and similar comminuting machines. The striker assembly may have a base capable of attachment to a rotor. The striker assembly further may have a striker blade attached to the base. Preferably the striker blade may be attached to the base via an adjustment portion of the base. The adjustment portion may allow the positioning of the striker blade to be adjustable to accommodate for dulling of the blade caused by extended use of the chipper, or to accommodate for varying sizes of blades. In one embodiment, the position of the striker blade may be adjusted to maintain a specific distance range between the striker blade and a grate of the chipper.

The chipper operates by breaking down material using the force of the striker blades attached to the rotor. A grate is employed on the chipper to allow appropriately sized material to pass through and out of the chipper, and also to facilitate the chipping process. To maintain optimal operation of the chipper, the distance between the edge of the striker blade and the grate of the chipper must be within a specific tolerance range. This distance and range may vary greatly depending on the size of the chipper and the material being chipped. In one embodiment, the distance may be ½ inch, plus or minus ¼ inch. In another embodiment, the distance may be 1 inch plus or minus ½ inch.

The striker assembly may be of any size and shape that may be mounted to a rotor and used in a wood chipper. Further, the striker assembly may be of any material resilient enough to withstand the forces of the operation of the wood chipper. Materials of which the striker assembly may be made include but are not limited to steel, stainless steel, aluminum, or other metals, composite materials, hard plastic, and the like.

The striker assembly may have a base to provide structure for the striker assembly. The base of the striker assembly may be attached to a rotor in any way that allows securement of the base sufficient to withstand the large force loads that the striker endures during operation. In one embodiment, the base is bolted to the rotor by a bolt. In another embodiment, a plurality of bolts are employed to attach the base to the rotor. In yet another embodiment, a base surface that attaches to a rotor may be curved to match a curvature of the rotor. In another embodiment, the rotor may have a carrying face that provides a flat surface to receive a corresponding flat base surface that attaches to the rotor. In another embodiment, the base may be welded to the carrying face.

The base of the striker assembly may have a structure to facilitate attachment of the adjustment portion and the striker blade. In one embodiment, the structure may be in the form of an oval shaped aperture formed through the base. The oval shaped aperture may receive a bolt in various positions allowing for varying attachment configurations of the adjustment portion and the striker blade. In another embodiment, the structure may allow the adjustment portion to be slideably mounted to the base.

The striker blade of the striker assembly is the portion of the assembly that does the actual chipping. As such, the striker blade bears a substantial amount of the compressive and impact forces. The blade may operate to do a substantial amount of the chipping by being placed on the base surface that contacts substantially all of the wood or other material to be chipped when the rotor is rotating. The blade may be attached to the adjustment portion of the base by any means that may secure the blade to the adjustment portion and bear the compressive and impact forces that the blade is subject to. In one embodiment, the blade may be attached to the adjustment portion by a bolt passing through the blade, the adjustment portion, and the length of the base. In an embodiment where the adjustment portion is slideably attached to the body, the striker blade may be mounted to the adjustment portion directly, by bolt, weld, or other connection.

The positioning of the blade contemplated herein may be adjustable via the adjustment portion of the base such that it may operate at varying positions, allowing it to be adjusted as it wears over time and use, or to allow various types of blades and blade sizes. The adjustment portion is designed to allow the striker blade to be secured to the base in a plurality of adjustment positions.

In one embodiment, the adjustment portion may have two removably attachable parts. A first part of the adjustment portion may have a flat rear face that abuts the base when attached, and a front face that has a plurality of grooves. The second part of the adjustment portion may have a rear face that has a plurality of grooves. The grooves on the rear face of the second part are capable of interlocking with the grooves on the front face of the first part in a plurality of different positions.

The second part of the adjustment portion may have a front face constructed to receive a striker blade. The first and second parts of the adjustment portion may be positioned such that the grooves interlock, and the striker blade may then be secured to the second part, which may be secured to the base. Therefore, the adjustment portion may be moved to one of the plurality of interlocking groove positions, such that the distance between the striker blade and a grate of the chipper is within a specified tolerance.

The front face of the second part of the adjustment portion may have a raised section that is designed to mate with a depressed section of the striker blade. The raised section may be of any shape that facilitates the secure attachment of the striker blade. As is known in the art, different striker blade models may have different shaped indented portions. Therefore, the front face may have different shaped raised portions that mate with the different blade indented portions. In one embodiment, the raised section may be a pyramid shape. In another embodiment, the raised section may be substantially circular with a cross indented through a center of the raised section. In yet another embodiment, the raised section may be a substantially oval shaped protrusion.

Preferably, the interlocking grooves of the adjustment portion may be equally spaced from each other, thereby allowing the grooves to fit together in a plurality of different positions. Therefore, the adjustment device may be moved from a first position, to a second position, to a third position and the grooves will still interlock. This construction may provide incremental positioning of the blade based on the positioning of the adjustment portion. In one embodiment, the grooves are spaced ¼ inch apart. Therefore, the adjustment portion may move incrementally ¼ inch for each position. It should be understood that the groove spacing may vary depending on the size of the chipper, the application, and the range of the distance tolerance between the blade and the grate.

It should be understood that other structures may allow the striker blade to be attached to the base in a plurality of positions, achieving the same results as the interlocking grooves previously described, without straying from the scope of the present invention. For example, in one embodiment, a frictional connection may be used to adjust the positioning of the blade in respect to the base by utilizing an aperture formed by the base that may accept a bolt in a variety of positions. In another embodiment, the blade may be mounted on an adjustment portion formed as a track, and its position may be controlled by a screw apparatus, such that by adjusting the screw, the blade may be extended or retracted. In yet another embodiment, the blade positioning may be adjusted by a ratcheting device that permits motion in a first direction, and substantially prohibits motion in a second direction.

In operation, one embodiment of the present invention allows a position of the striker blade to be adjusted as the striker blade wears. Initially, the blade is installed on an adjustment portion of the body in a first position, such that the blade is positioned within a specified distance tolerance between an edge of the blade and a grate of the chipper. Over time, and once the blade is worn such that the distance between a blade edge and the grate distance exceeds the distance tolerance, the blade may be moved to a second position by re-arranging the adjustment portion. In this second position, the blade is again within the specified distance tolerance between the edge of the blade and the grate, such that the blade may again be fully operational. Optionally, the worn portion may be cut, shaved down, or snapped off, creating a fresh blade operating portion nearly identical to the initial blade configuration. This process may be repeated multiple times until the blade has been shortened such that it is not capable of withstanding the forces of chipper operation.

In one embodiment, the adjustment of the chipper striker blade may involve evaluating an amount of wear on a striker blade; detaching the striker blade from a base of a striker assembly, and positioning the striker blade such that a distance between the striker blade and a grate of the chipper is within a specified tolerance.

In another embodiment, the step of evaluating the amount of wear on a striker blade may be performed visually by an inspector. In another embodiment, the evaluation may be performed by measurement of the distance of the striker blade from the grate using a measurement device to determine if the distance is outside of a specified tolerance.

In one embodiment, the step of positioning the striker blade such that the distance between the striker blade and a grate of the chipper is within a specified tolerance may be performed by moving an adjustment device of the base, and measuring distance by visual inspection. In another embodiment, the distance of the striker blade from the grate may be performed by moving an adjustment device and measuring distance using a measurement device to confirm that the distance is within of a specified tolerance range.

An unexpected and advantageous feature of the present invention is its inherent breakaway feature. Because of the adjustability of the adjustment portion, in the event that the striker blade impacts a very hard object, the adjustment portion may retract from a second position to a first position, to bring the blade to a lowered position, and absorbing the force from the impact. As is known in the art, it is not uncommon that a stone, metal fragment or other very hard object becomes entrapped within the chipper during operation. Typically this object can cause severe damage to the chipper, and in addition can result in striker blades coming loose and further damaging the chipper. However, the striker assembly of the present invention allows the striker blade to retract by sliding from a second position of the adjustment portion to a first position when the striker blade encounters a specified force. This specified force may vary depending on the size and operating conditions of the chipper.

In one embodiment, the break away feature may be designed into the protruding grooves of the adjustment portion second part. For example, the protruding grooves of the adjustment portion first part may be sized such that under a specified shearing force, they may give way and allow the striker blade to retract.

In another embodiment, the break away feature may be designed by tightening the bolt holding the striker assembly elements together to a designated torque. At this designated torque, the adjustment portion may be allowed to slip from a second position to a first position if the striker blade encounters a very hard object.

Turning now to FIG. 1, an exploded view of an embodiment of the present invention is shown. A base 104 of the striker assembly is attached to a carrying face 102, which in turn is connected to a rotor 101. The base 104 defines a base aperture 112 which accepts a bolt 109. Connectable to the base is an adjustment portion comprising a first part 105 and a second part 108. The adjustment portion first part 105 comprises a plurality of indented grooves 106 extending radially outwardly relative to the rotor 101 which is height-wise relative to the base 104. The adjustment portion second part 108 comprises a plurality of protruding grooves 107 extending radially outwardly relative to the rotor 101 which is height-wise relative to the base 104. The protruding grooves 107 are constructed to mate with the indented grooves 106 in a plurality of different positions. A raised section 113 extends from a front face of the adjustment portion second part 108. The raised section 113 is sized to mate with a striker blade 114.

A bolt 109 is employed to hold the striker blade 114, adjustment portion second part 108 and adjustment portion first part 105 to the base 104. The bolt 109 passes through a striker blade aperture 115 formed by the striker blade 114, a second part aperture 110 formed by the second part of the adjustment portion 108, a first part aperture 111 formed by the first part of the adjustment portion 105, and a base aperture 112, formed by the base 104. The bolt 109 is then secured, and thereby holds the elements together and in place.

Figure 2:
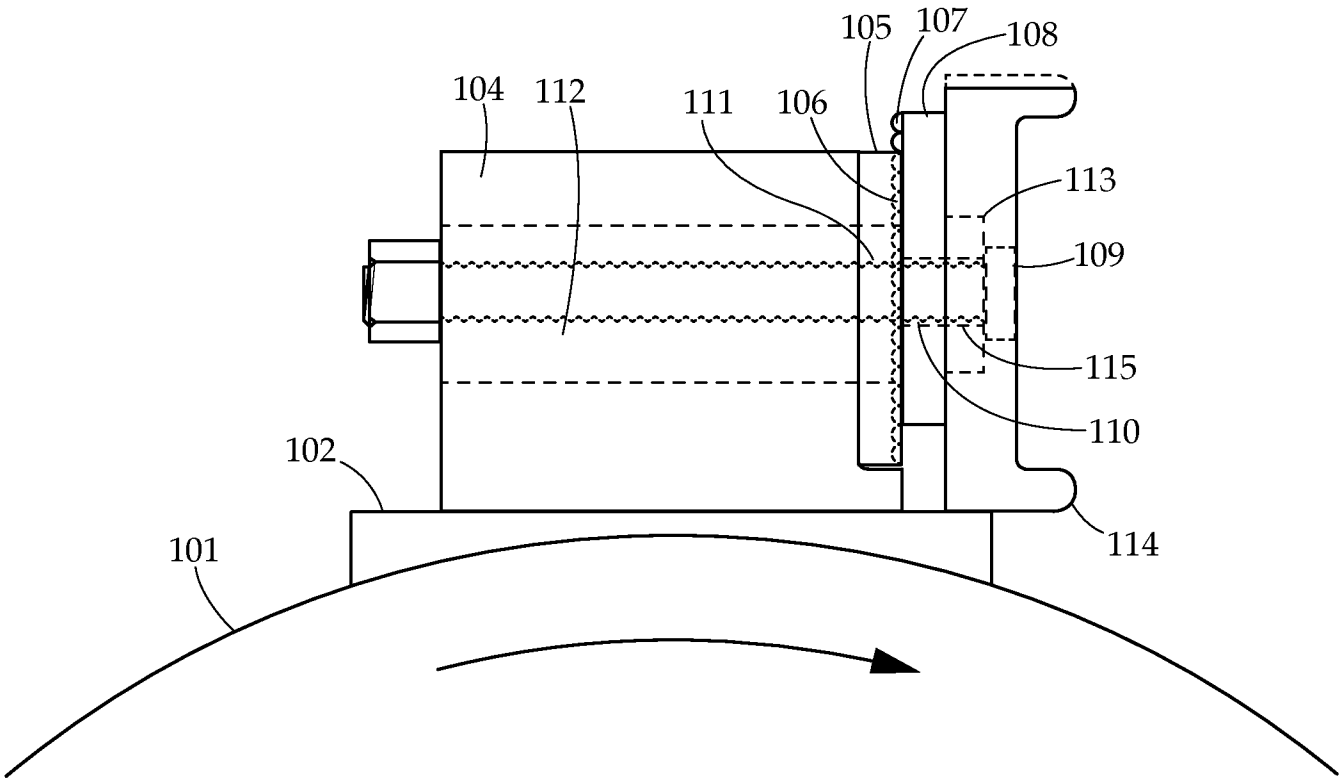
FIG. 2 provides an illustration of an embodiment of a side view of the present invention with the adjustment portion configured in an adjusted position based on wear on the striker blade.

FIG. 2 shows a side view of the present invention with the adjustment portion configured in an adjusted position based on wear on the striker blade 114. The base 104 is connected to a carrying face 102 which in turn is connected to a rotor 101. The base 104, adjustment portion first part 105 and second part 108, and the striker blade 114 are bolted together by a bolt 109 that passes through a striker blade aperture 115 formed by the striker blade 114, a second part aperture 110 formed by the second part of the adjustment portion 108, a first part aperture 111 formed by the first part of the adjustment portion 105, and a base aperture 112, formed by the base 104. This view shows the adjustment portion second part 108 offset from the adjustment portion first part 105. This offset position allows the indented grooves 106 to mate with the protruding grooves 107. The exact positioning of the second part 108 in relation to the first part 105 is determined by the amount of wear on the striker blade 114. This view shows the original striker blade in dotted lines, and in solid lines shows the current striker blade 114 structure caused by the wearing of the striker blade 114 from use. A raised section 113 extends from a front face of the adjustment portion second part 108, and is mated with an indented portion of the striker blade 114.

Figure 3:
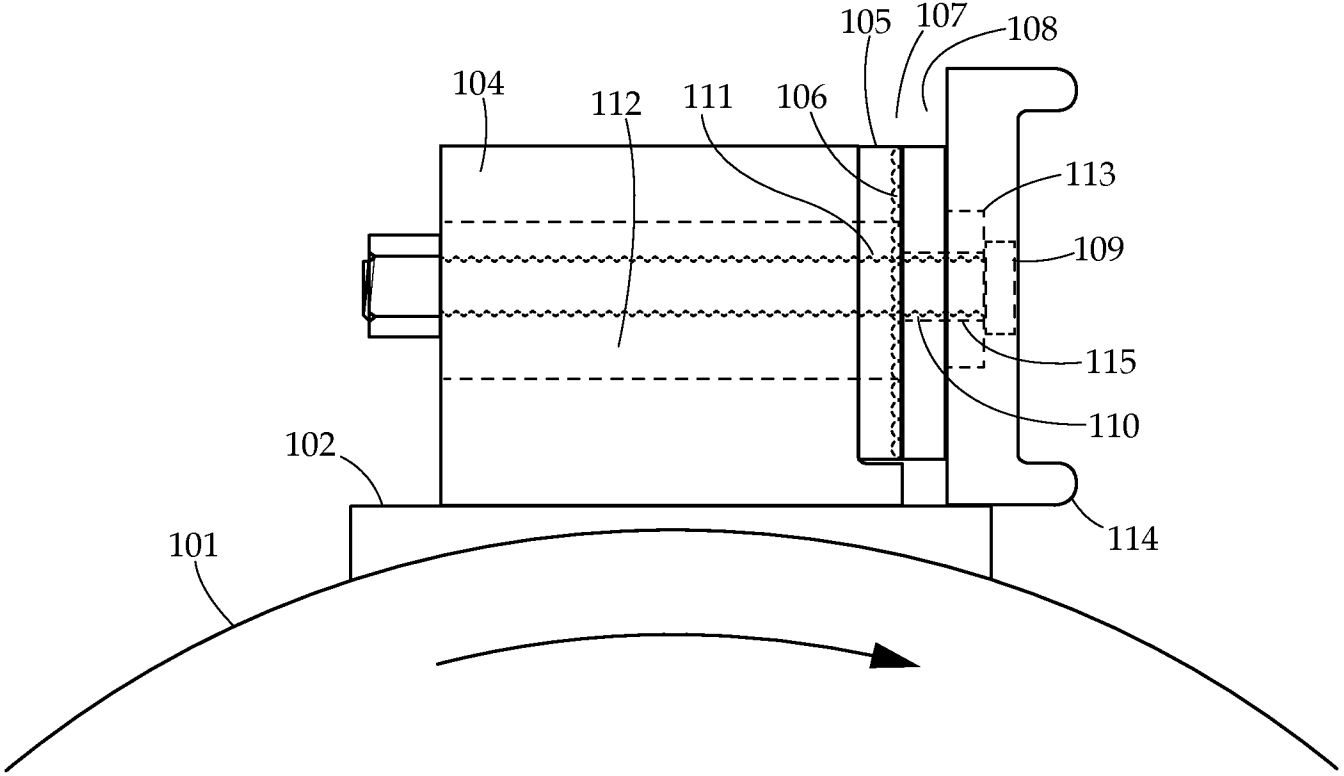
FIG. 3 provides an illustration of shows a side view of an embodiment of the striker assembly with a new, un-worn striker blade.

FIG. 3 shows a side view of the striker assembly with a new, un-worn striker blade 114. The base 104 is connected to a carrying face 102 which in turn is connected to a rotor 101. The base 104, adjustment portion first part 105 and second part 108, and the striker blade 114 are bolted together by a bolt 109 that passes through a striker blade aperture 115 formed by the striker blade 114, a second part aperture 110 formed by the second part of the adjustment portion, a first part aperture 111 formed by the first part of the adjustment portion, and a base aperture 112, formed by the base 104. This view shows the adjustment portion second part 108 in line with the adjustment portion first part 105. This in line position allows the indented grooves 106 to mate with the protruding grooves 107. The first part 105 and second part 108 are constructed to be in line with each other when a new striker blade 114 is installed. A raised section 113 extends from a front face of the adjustment portion second part 108, and is mated with an indented portion of the striker blade 114.

Figure 4:
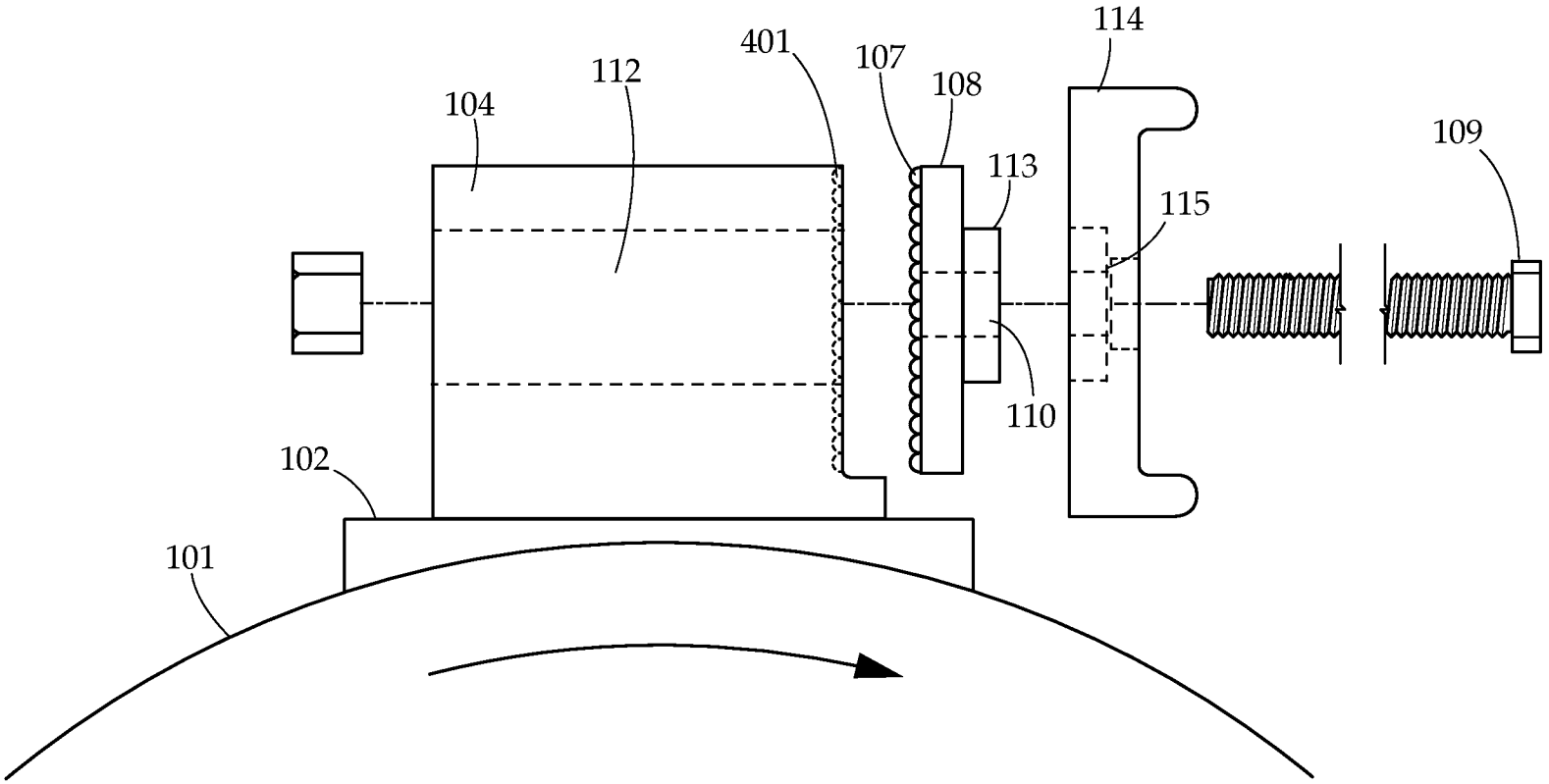
FIG. 4 provides an illustration of an exploded view of an embodiment of the present invention.

FIG. 4 shows an exploded view of an embodiment of the present invention. In this embodiment, the adjustment portion comprises a plurality of base grooves 401 indented into a face of the base 104, the base grooves extending radially outward relative to the rotor 101 which is height-wise along the base 104. An adjustment portion second part 108. The base 104 is connected to a carrying face 102 which in turn is connected to a rotor 101. The adjustment portion second part 108 has a plurality of protruding grooves 107 on a rear face. The protruding grooves 107 are constructed to mate with the base grooves 401 in a plurality of different positions and are extending radially outwardly relative to the rotor 101 which is height-wise relative to the base 104. A raised section 113 extends from a front face of the adjustment portion second part 108. The raised section 113 is sized to mate with a striker blade 114.

A bolt 109 is employed to hold the striker blade 114 and adjustment portion second part 108 to the base 104. The bolt 109 passes through a striker blade aperture 115 formed by the striker blade 114, a second part aperture 110 formed by the second part of the adjustment portion, and a base aperture 112, formed by the base 104.

Figure 5:
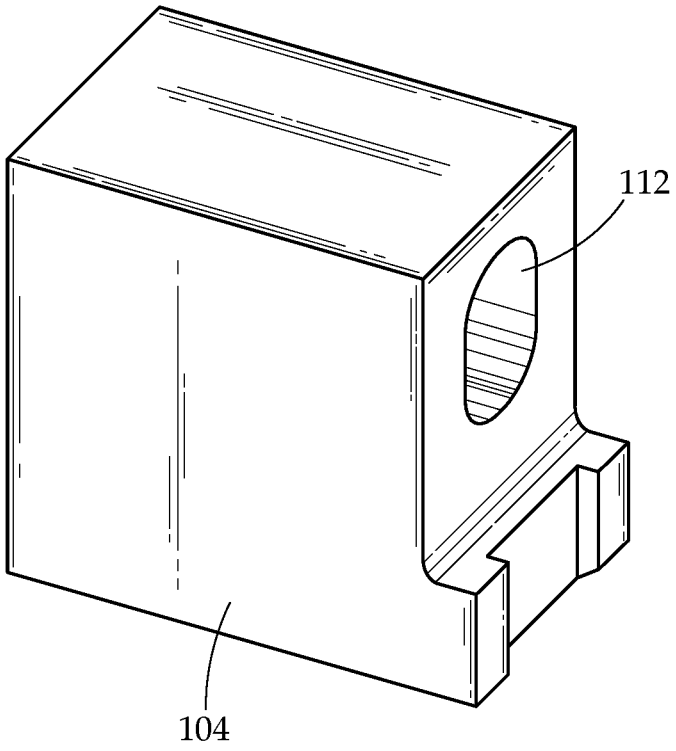
FIG. 5 provides an illustration of a perspective view of an embodiment of the base.

FIG. 5 shows a perspective view of the base 104. The base 104 has a base aperture 112 which has a substantially oval shaped cross section. The oval shape of the base aperture 112 allows a bolt (not shown) or other connecting device to be positioned in a plurality of different locations. For example, a bolt may be at a bottom portion of the base aperture 112; a central portion of the base aperture 112; or a top portion of the base aperture 112.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A wood chipper having a chipper striker assembly, the wood chipper comprising:

a rotor within the wood chipper;

a grate within the wood chipper and spaced apart from the rotor;

the striker assembly of the wood chipper comprising:

a base, attached to the rotor of the chipper;

an adjustment portion connected to the base;

a striker blade, connected to the adjustment portion;

wherein the adjustment portion is capable of connection to the base in a plurality of adjustment positions, such that the striker blade is adjustable in a radial direction relative to the rotor;

wherein the adjustment portion has a first part and a second part;

the adjustment portion first part having a flat rear face abutting a surface of the base, and a front face having a first plurality of grooves oriented parallel to an axis of the rotor and which extend in a height-wise radial outward direction relative to the rotor;

the adjustment portion second part having a rear face having a second plurality of grooves oriented parallel to an axis of the rotor and which extend in a height-wise radial outward direction relative to the rotor; and wherein the plurality of first grooves of the first part and the plurality of second grooves of the second part are selected to be mated together in a relative position such that a distance between the striker blade and the grate of the chipper is within a specific tolerance range.

2. The chipper striker assembly of claim 1 wherein the plurality of protruding grooves of the second part are constructed and arranged to be attached to the plurality of indented grooves of the first part in a plurality of different adjustment positions.

3. The chipper striker assembly of claim 1 wherein the striker blade is removably attachable to the adjustment portion.

4. The chipper striker assembly of claim 1 wherein the adjustment portion is in a first position when the striker blade is new, and a second position when the striker blade is worn.

5. The chipper striker assembly of claim 1 wherein the plurality of indented grooves of the first part and the plurality of protruding grooves of the second part provide incremental positioning and attachment of the striker blade in relation to the grate of the chipper.

6. The chipper striker assembly of claim 1 further comprising a carrying face constructed and arranged to facilitate attachment of the base to the rotor.

7. The chipper assembly of claim 1 wherein the adjustment portion is connected to the base by a bolt.

8. The chipper assembly of claim 6 wherein the base further comprises a substantially oval shaped aperture to receive the bolt in a plurality of different positions.

9. A chipper striker assembly comprising:

a base, attached to a rotor of the chipper, and having a first plurality of grooves formed by an outer face, the plurality of grooves oriented parallel to an axis of the rotor and extend in a height-wise radial outward direction relative to the rotor;

an adjustment portion connected to the base, having a second plurality of grooves on a rear face oriented parallel to an axis of the rotor and which extend in a height-wise radial outward direction relative to the rotor to which the base is capable of attachment, the second plurality of grooves mating with the first plurality of grooves;

a striker blade, connected to the adjustment portion;

wherein the adjustment portion is capable of connection to the base in a plurality of adjustment positions, allowing the striker blade to be adjustable in a radial direction relative to the rotor; and wherein the adjustment portion and base are selected to be mated in a relative position such that a distance between the striker blade and a grate of the chipper is within a specific tolerance.

10. The chipper striker assembly of claim 9 wherein the adjustment portion is in a first position when the striker blade is new, and a second position when the striker blade is worn.

* * * * *